US006296364B1

(12) United States Patent
Day et al.

(10) Patent No.: US 6,296,364 B1
(45) Date of Patent: Oct. 2, 2001

(54) LIGHTED BEAD NECKLACE

(75) Inventors: David W. Day, Houston; Jeffery T. Relf, Kingwood, both of TX (US); Leslie Jackson, New Orleans, LA (US)

(73) Assignee: Big Easy Beads, LLC, New Orleans, LA (US); a part interest ( * ) Notice: Subject to any disclaimer, the term of this patent is extended or adjusted under 35 U.S.C. 154(b) by 0 days.

(21) Appl. No.: 09/437,048

(22) Filed: Nov. 9, 1999

(51) Int. Cl.[7] ..... F21V 21/08

(52) U.S. Cl. ..... 362/104; 362/103; 362/184; 362/227; 362/249; 362/252; 362/800

(58) Field of Search ..... 302/103, 104, 302/184, 227, 249, 252, 800, 806

(56) References Cited

U.S. PATENT DOCUMENTS

| | | | | |
|---|---|---|---|---|
| 3,755,663 | * | 8/1973 | George, Jr. | 240/10 R |
| 3,805,047 | | 4/1974 | Dockstader | 240/6.4 W |
| 4,076,976 | | 2/1978 | Fenton | 362/104 |
| 4,096,552 | | 6/1978 | Ben-Porat | 362/104 |
| 4,101,955 | * | 7/1978 | DuNah | 362/104 |
| 4,779,172 | * | 10/1988 | Jimenez et al. | 362/104 |
| 4,930,052 | | 5/1990 | Beige | 362/104 |
| 5,201,578 | | 4/1993 | Westmoland | 362/104 |
| 5,477,433 | * | 12/1995 | Ohlund | 362/104 |

* cited by examiner

*Primary Examiner*—Sandra O'Shea
*Assistant Examiner*—Ismael Negron
(74) *Attorney, Agent, or Firm*—Garvey, Smith, Nehrbass & Doody, L.L.C.

(57) ABSTRACT

A light-emitting beaded necklace for ornamental decoration having a plurality of ornamental beads that each define opposed slots for receiving the beads on an elongate thread. At least one light source is enclosed within one of the beads. The elongate thread extends through the opposed slots of the beads in sequence and distal ends connect together to define a looped article of wearing apparel. The necklace has pendent with a circuit for generating an electrical signal for illuminating the light source to provide a lighted ornamental effect for the beaded necklace. A method of assembling a light-emitting beaded necklace is disclosed.

21 Claims, 3 Drawing Sheets

LIGHTED BEAD NECKLACE

TECHNICAL FIELD

The present invention relates to bead necklaces. More particularly, the present invention relates to bead necklaces having illuminated beads for ornamental decoration of persons especially at festivals.

BACKGROUND OF THE INVENTION

Ornamental decorations are often used at public events, festivals, parties, parades, and the like, to enliven the activities and enjoyments of the attendees. Among these well-known events are Mardi Gras, New Year's Eve events, Christmas parades, and other such celebratory public and private events. The ornamental decorations include signage, flags, hats, stylized costumes, and special jewelry and apparel decorations including buttons and necklaces. The manufacture and sales of such special articles and decorations has become a significant business. Attendees often purchase these special articles and decorations from stores, shops, and street vendors.

One type of such ornamental decoration is beaded necklaces. These necklaces typically use brightly colored, faceted beads strung onto an elongate cord for wearing around the neck. For example, many persons appearing on floats and in the streets during Mardi Gras parades wear such beaded necklaces, and often, persons on floats throw additional necklaces to persons observing the parades. Persons attending such events often use as one measure of evaluating their enjoyments based on the number of different necklaces "won" or received during the parade. The beaded necklaces also typically include enlarged, stylized pendents that celebrate the particular sponsors of the floats or generally relate with text and/or graphics to the events. Other similar beaded necklaces for festival participants are available from stores and street vendors.

To promote the excitement and enjoyment of the attendees, the beads are highly stylized and often reflect ambient lights such as from the floats, street lights, and shops along the parade route. The beads often are unitary articles with faceted faces and are made of brightly colored or shiny plastics. The beads have opposing, openings through which a cord extends, whereby the beads are strung together on the cord to form the necklace. To provide ornamental lighting effects, elongate plastic tubes containing light-generating chemicals have been used. The tubes form closed loops by engaging short connectors on the opposing ends so that the light-emitting loops may be worn around the neck or in the hair of attendees. Heretofore however, additional lighting has not been used directly in the beaded necklaces.

Accordingly there is a need in the art for providing improved bead necklaces having light sources for ornamental decoration of festival attendees. It is to such that the present invention is directed.

BRIEF SUMMARY OF THE INVENTION

The present invention meets the need in the art by providing a light-emitting beaded necklace for ornamental decoration, comprising a plurality of ornamental beads that each define opposed slots. At least one light source is enclosed within a respective one of the beads. An elongate thread extends through the opposed slots of the beads in sequence. The thread has distal ends that connect together to define a looped article of wearing apparel. The necklace includes means for generating an electrical signal for illuminating the light source in one of the beads, in order to provide a lighted ornamental effect for the beaded necklace.

In another aspect, the present invention provides an elongate thread bundle, for joining together in a sequence of thread bundles to form a light emitting necklace with a first and a second one of the thread bundles attached at one respective end to a source of electrical power to complete an electrical circuit for powering the light sources. The thread bundle comprises an elongate tether member and at least one pair of electrically conductive members for connecting a light source to a source of electrical power. A jacket encloses the tether member and the conductive members, which have distal ends extending outwardly of opposing ends of the jacket for connecting a light-emitting bead attached to a first one of the opposing ends of the tether. The pair of signal communicating members connect to a light source.

In another aspect, the present invention provides a light emitting necklace that has at least two threaded bead assemblies joined together to define a necklace. Each bead assembly comprises an elongate thread bundle having a tether and at least two signal members for communicating electrical signals, and at least one of the signal members defining a common member. At least two beads are received on the bead assembly. The bead assembly has at least one light source adapted for attaching to the thread bundle at one end thereof by engaging a respective distal end of the tether and connecting the light source to the common member and to a selected one of the signal members, the remaining signal members and common member being connected to mating signal members and common member in an adjacent thread bundle. The necklace includes signal means for generating electrical signals for illuminating each of said light sources in a sequence.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
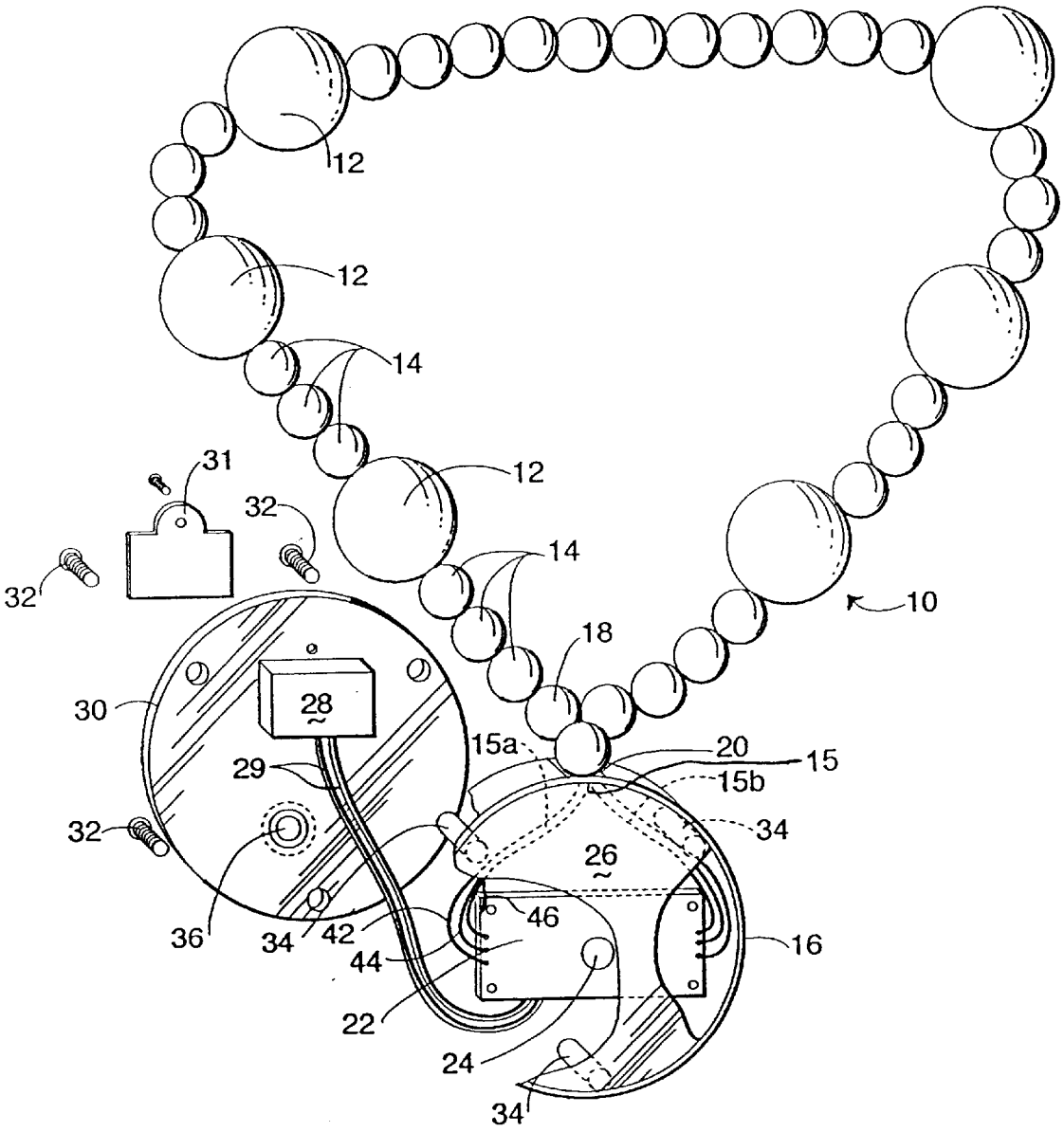
FIG. 1 is an exploded perspective view of an embodiment of a beaded necklace with illuminative beads according to the present invention.

Referring now in more detail to the drawings in which like parts have like identifiers, FIG. 1 illustrates in exploded perspective view a light-emitting necklace 10 in accordance with the present invention. The necklace 10 includes a plurality of light-emitting beads 12 and conventional non-illuminative beads 14. The beads 12, 14 are threaded or strung onto a cord 15 that includes electrical signal members for communicating electrical current to actuate the light-emitting beads 12, as discussed below.

A pendent 16 connects by a tri-bead 18 (discussed below with respect to FIG. 4) to the necklace 10. The pendent 16 defines a slot 20 for receiving a portion of the tri-bead 18 and through which the cord passes into the pendent. In the illustrated embodiment, the pendent 16 includes a circuit board 22 having a controller for selectively activating the light-emitting beads 12. In the illustrated embodiment, the circuit board 22 includes a light source 24 which emits light outwardly of a front face 26 of the pendent. The circuit board 22 connects to electrical members 42,44 and a tether 46 in the cord 15, as discussed below. In the illustrated embodiment, the circuit board 22 connects to a pair of the cords 15, as discussed below. The pendent 16 selectively includes text and ornamental graphics (not illustrated) on the front face 26 or the side wall of the pendent reflective of a celebratory event, for example, Mardi Gras, New Year's Eve, or other festival or celebration. In the illustrated embodiment, the pendent 16 is a circular disk, although other shapes may be used. In an alternate embodiment, a separate cover matingly engages the front face 26. The cover includes graphics or text for special events, while the pendent provides a common receptacle.

A battery compartment 28 selectively receives batteries (not illustrated) for providing electrical power to the circuit board 22 and for the light-emitting beads 12. In the illustrated embodiment, the battery compartment 28 is part of a back cover 30. A pair of wires 29 connect between the battery compartment 28 and the circuit board 22 for communicating electrical current to the circuit board. A plate 3 with a threaded fastener detachably closes the battery compartment 28. The back cover 30 connects with threaded fasteners 32 to posts 34 extending from an interior surface of the pendent 16. A button 36 extends through an opening defined in the back cover 30 and bears against a switch on the circuit board 22. It is appreciated that other switching mechanisms may be gainfully used in accordance with the present invention.

Figure 2:
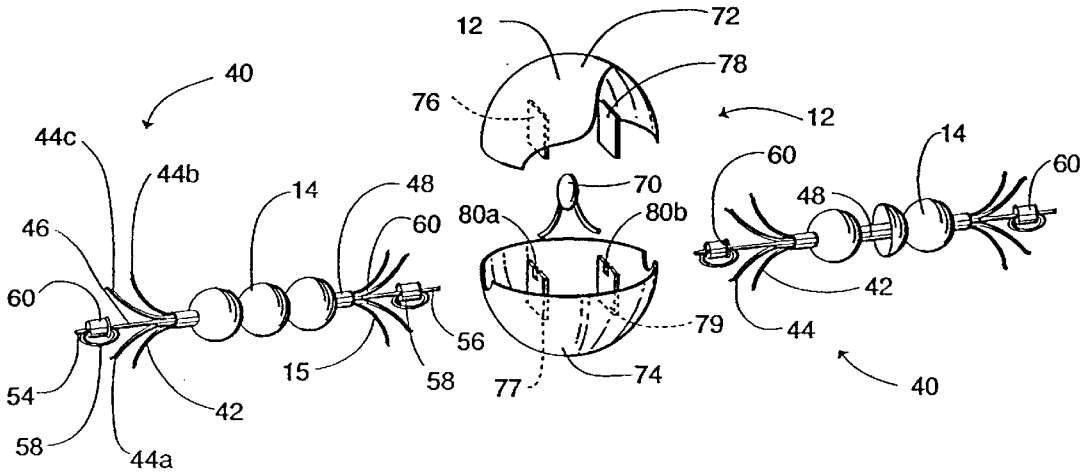
FIG. 2 is an exploded perspective view of a thread bundle and illuminative bead for use in the beaded necklace illustrated in FIG. 1.

FIG. 2 is an exploded perspective view of a thread bundle 40 used as a portion of the cord 15 to string the beads 12, 14 for assembling the beaded necklace 10. A plurality of thread bundles 40 join together in accordance with the present invention to form the necklace 10. The thread bundle 40 includes at least two members 42, 44 for communicating electrical signals from the circuit board 22 to the light-emitting beads 12 and a tether 46. The thread bundle 40 in the illustrated embodiment includes a jacket 48 that encloses the members 42, 44 and the tether 46. Respective distal end portions of the members 42, 44, and the tether 46 extend from the opposing ends of the jacket 48. The thread bundle 40 receives one or more of the beads 14. As with such conventional beads, the beads 14 include opposed openings through which the thread bundle 40 extends. In the illustrated embodiment, the respective distal ends 54, 56 of the tether 46 terminate in a looped portion 58 of the tether and secured with a clasp 60. The clasp 60 preferably is a metal plate that receives the tether 46 and folds to grip the tether. The tether 46 is a flexible, high strength cord, and in a preferred embodiment, is high test monofilament nylon fishing line. The tether 46, interconnects the beads 12 and provides strain relief while the necklace 10 is used.

FIG. 2 also illustrates a preferred embodiment of the light-emitting bead 12 that contains a light source 70 which preferably is a light emitting diode (LED), or other such light emitting device. Preferably, the light source 70 is a low voltage, low wattage device. The light source 70 is received within the light-transmissive bead 12 formed from opposing matable shells 72, 74. The shell 72 includes a pair of plates 76, 78 that extend from an interior surface of the shell towards an open side for mating contact with a pair of aligned opposing plates 77, 79, respectively in the opposing shell 74. The plates 77, 79 in the shell 74 each define a slot 80 for receiving respective distal ends 54, 56 of the tethers 46.

Figure 3:
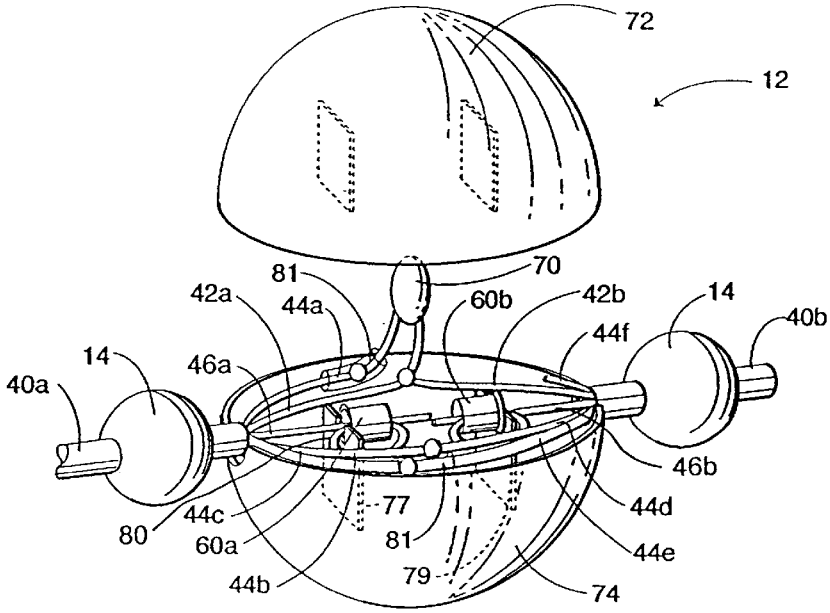
FIG. 3 is a detailed perspective view of an illuminative bead with a pair of thread bundles connected together and a light source for use in the beaded necklace illustrated in FIG. 1.

FIG. 3 is a detailed perspective view of one of the light-emitting beads 12 with a pair of the thread bundles 40*a*, 40*b* connected together. In the illustrated embodiment, the thread bundle 40*a* includes one common electrical signal member 42*a* and three electrical signal members 44*a*, 44*b*, and 44*c*. The electrical signal members 42*a*, 44*a* of the thread bundle 40*a* connect to the light source 70, in accordance with the present invention. The clasp 60*a* abuts the plate 77 with the tether 46*a* received in the slot 80. The second thread bundle 40*b* includes one common electrical signal member 42*b* and three electrical signal members 44*d*, 44*e* and 44*f*. The clasp 60*b* abuts the plate 79 with the tether 46*b* received in the slot 80.

The common members 42*a*, 42*b* electrically join to a lead of the light source 70. The other lead of the light source 70 connects to the electrical signal member 44a. The electrical signal members 44*b* and 44*c* electrically connect with the electrical signal members 44*d* and 44*e* , respectively. Shields 81 enclose the respective connections between the electrical members 44*b*, 44*d* and 44*c*, 44*e* and 44*a* with the lead from light source 70. The shields 81 are preferably tubular plastic non-conducting sleeves. The electrical signal member 44*f* is clipped off at the distal ends of the thread bundle 40*b*. Accordingly, the electrical signal member 44*f* remains within the jacket 48, but is not electrically connected in the thread bundle 40*b*. Only the electrical members 44 needed for subsequent light sources 70 in the necklace 10 are connected to preceding members 44 in the light-emitting bead 14.

The shell 74 matingly connects to the shell 72 to enclose the light source 70 and the electrical connections of the members 42, 44 as discussed above. The opposing plates 76, 78 in the shell 72 bear against the aligned slotted plates 77, 79 in the shell 74 to secure the tethers 46*a*, 46*b* in the slots 80. The shells 72, 74 rigidly connect together, such as by ultrasonic welding, adhesive, or other suitable connecting agents. In an alternate embodiment, the shell 72 does not include the plates 76, 78, and the tethers 46 are secured in the slots 80 with adhesive or other suitable securing material.

Figure 4:
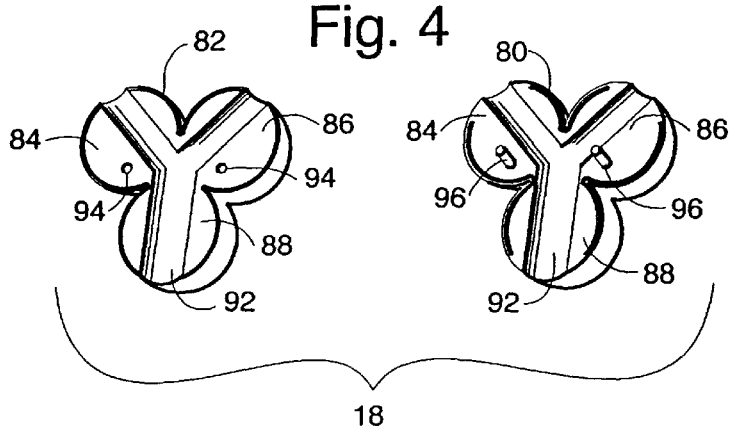
FIG. 4 is a perspective view of mating parts of a connector used with the beaded necklace illustrated in FIG. 1.

FIG. 4 is a perspective view of mating parts 80, 82 of the tri-bead 18 which connects the pendent 16 to two of the thread bundles 40. The parts 80, 82 comprise three petals 84, 86, and 88, and define exterior surfaces that conform stylistically to the beads 12, 14 used in the necklace 10. The interior faces of the parts 80, 82 define Y-shaped channels 92 that extend along respective central portions of the three petals 84, 86, and 88. The part 80 defines a pair of holes 94. The part 82 defines a pair of posts 96 that align with and engage the holes 94 when the mating parts 80, 82 join together. The channel 92 in the petal 84 is sufficiently wide to receive two thread bundles 40, while the channel 92 in the petals 86 and 88 are sufficiently wide to receive one thread bundle 40. The parts 80, 82 rigidly connect together by ultrasonic welding, adhesive, or other suitable agent.

Figure 5:
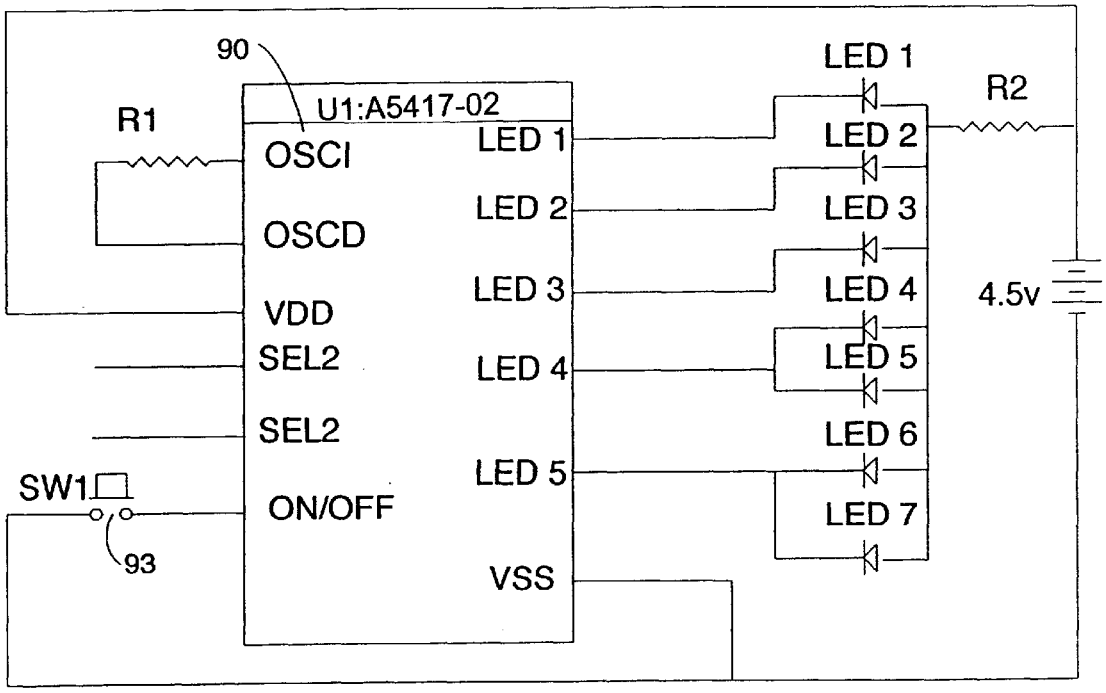
FIG. 5 is a circuit diagram for an embodiment of the light emitting beaded necklace having seven light sources.

FIG. 5 is a circuit diagram for an embodiment of the light emitting beaded necklace having seven light sources—LED1–LED7 contained in the light emitting beads 12 and the pendent 16—as illustrated in FIG. 1. The circuit uses a conventional integrated circuit 90 to communicate electrical power selectively to the light emitting diodes LED1–LED7. A switch 93 selectively actuates the circuit 90. In the illustrated embodiment, the integrated circuit 90 is commercially available A5417-02, which provides a driving controller for flashing light sources 70 in a pattern. Other conventionally available integrated circuits have a variety of light flashing patterns, such as sequential on/off, cascading, random, and other patterns. In the illustrated embodiment, the circuit uses 4.5 volts direct current, with resistor R1 of 100 ohms and resistor R2 of 220 k ohms.

The lighted beaded necklace 10 of the present invention is assembled from a plurality of the thread bundles 40, beads 12, 14, and pendent 16. With reference to FIG. 2, the thread bundle 40 is made by providing a plurality of electrical signal members 44 on spools, such as spools of metal wires. The spools feed together with a line from a spool of fishing line and are enclosed within the jacket 48, which is conventional for forming multi-line bundles of wiring. The resulting continuous bundle is readily rolled onto a spool. Portions of the bundle are cut to length to form the thread bundles 40. Distal portions of the jacket 48 are removed so that the distal ends of the members 42, 44 and the tether 46 extend outwardly of the ends of the jacket 48. A selected number of beads 12 are strung on the thread bundle 40. In the illustrated embodiment, the thread bundle 40 receives three of the beads 12. The looped portions 58 are formed in each of the opposing distal ends of the tether 46. The looped portions 58 arc secured with the clasps 60.

As can be seen in FIGS. 1–3, light-emitting beads 12 are larger than the conventional non-illuminative beads 14. Also, as shown in FIG. 1, each light-emitting bead 12 is separated from other light-emitting beads 12 by at least one conventional non-illuminative bead 14. As also shown in FIG. 1, each light-emitting bead 12 is separated from other light-emitting beads 12 by at least three conventional non-illuminative beads 14.

With reference to FIG. 3, two thread bundles 40*a*, 40*b* are connected together with a light source 70 in a light-transmissive bead 12. This forms a portion of the necklace 10. The common members 42*a*, 42*b* are soldered to one of the leads from the light source 70. The electrical signal member 44*a* connects to the second lead from the light source 70. The member 44*a* connects to an actuatable switch, such as in an electrical circuit, to selectively actuate the light source 70 in the bead 12, in a predetermined pattern. In the illustrated embodiment, the button 36 bears against a switch on the circuit board 22. The electrical signal members 44*b*, 44*c* in the thread bundle 40*a* connect by soldering to the electrical signal members 44*d*, 44*e* , respectively, in the thread bundle 40*b*. The sleeves 81 insulate the soldered connections. Thereby, the common and two electrical signal members 44 pass to subsequent light sources 70. The third electrical signal member 44*f* in the thread bundle 44*b* is clipped off and performs no further functions in subsequent connections of thread bundles. Accordingly, the present invention provides a readily assembled bundle 40 of electrical signal members 42, 44 with a tether 46. The common 42 and sufficient ones 44 of the electrical signal members are connected for illuminating subsequent light sources; each connection of a light source 70 drops one of the electrical signal members 44 for communication of electrical signals to subsequent thread bundles and light sources.

In the embodiment illustrated in FIGS. 1–5, the necklace 10 has six lighted beads 12 with one light source 24 in the pendent. Three of the lighted beads 12 are connected by a first sequence of thread bundles 40; the other three are connected by a second sequence of thread bundles 40. The distal lighted beads 12 (from the pendent 16) are joined together by a thread having the clasps 60 at distal ends. The initial thread bundle 40 in the first and second sequences of thread bundles (denominated for illustration as 15*a* and 15*b*) pass through the tri-bead 18 and into the pendent 16 for connection of the commons 42 and the electrical signal members 44 with a controller for selectively actuating the light sources 70. In the illustrated embodiment, the commons 42 and the electrical signal members 44 connect to outputs of an integrated circuit that selectively control the flashing patterns of the respective light sources 70. For example, the light sources 70 in the beads 12 may be set to flash on in a flowing sequence, chasing, all simultaneously, or other selected pattern in a conventional manner of sequencing the actuation of a series of illuminative ornamental lights.

An alternate embodiment uses a clasp structure instead of the pendent 16 for enclosing the circuit board 22 and the power supply. A person wearing the alternate embodiment disposes the clasp on a back surface of the neck.

It is thus seen that an apparatus and method of connecting illuminative beads to beaded necklaces is provided, which illuminative beads contain light sources activated selectively by a controller. While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. A light-emitting beaded necklace for ornamental decoration, comprising:

a plurality of ornamental beads adapted for being strung onto a thread, including ornamental beads having light sources therein and ornamental beads not having light sources therein, wherein there is at least one ornamental bead not having a light source therein between all adjacent ornamental beads having light sources therein;

an elongate thread which receives the beads in sequence and having distal ends connected together at distal ends to define a looped article of wearing apparel;

means for generating an electrical signal for illuminating the light sources in the beads, whereby the light sources, being caused to illuminate, provide a lighted ornamental effect for the beaded necklace.

2. The light-emitting necklace as recited in claim 1, further comprising a pendent of ornamental appearance attached to the thread in the sequence of beads.

3. The light-emitting necklace as recited in claim 1, wherein the beads each have opposed slots for receiving the thread.

4. The light-emitting necklace as recited in claim 1, wherein the ornamental beads having light sources therein are larger than the ornamental beads not having light sources therein.

5. The light-emitting necklace as recited in claim 1, wherein there are at least three ornamental beads not having light sources therein between all adjacent ornamental beads having light sources therein.

6. A light-emitting beaded necklace for ornamental decoration, comprising:

a plurality of ornamental beads adapted for being strung onto a thread, including ornamental beads having light sources therein and ornamental beads not having light sources therein;

an elongate thread which receives the beads in sequence and having distal ends connected together at distal ends to define a looped article of wearing apparel;

means for generating an electrical signal for illuminating the light sources in the beads, whereby the light sources, being caused to illuminate, provide a lighted ornamental effect for the beaded necklace; and a pendent of ornamental appearance attached to the thread in the sequence of beads, wherein the means for generating an electrical signal is disposed within the pendent.

7. The light-emitting necklace as recited in claim 6, wherein the means for generating an electrical signal comprises:

a source of electrical power;

a pair of electrical conductive members connected between the source of electrical power and the light sources.

8. The light-emitting necklace as recited in claim 7, further comprising means for activating the light sources in a pattern of flashing on and off.

9. The light-emitting necklace as recited in claim 8, wherein the means for activating activates the light sources in at least one sequential pattern of flashing on and off.

10. An elongate thread bundle, for joining together in a sequence of thread bundles to form a light emitting necklace with at least one of the thread bundles attached at one respective end to a controller having a source of electrical power for powering a light source, comprising:

an elongate tether member having distal ends with securing members disposed thereon whereby the tether is engagable at the distal ends to portions of a necklace;

at least one pair of electrically conductive members having distal ends for connecting a light source to a source of electrical power; and a jacket for enclosing the tether member and the conductive members, the distal ends of the pair of conductive members extending outwardly of opposing ends of the jacket for connecting in sequence to the light source and to another thread bundle, for assembling a necklace.

11. The thread bundle as recited in claim 10, wherein the light source is held within a bead that communicates light therefrom, the beads being attached to the tether and enclosing electrical connections of the conductive members and the light source.

12. A light emitting necklace, comprising:

at least two threaded bead assemblies joined together to define a necklace, each bead assembly comprising:

an elongate thread bundle having a tether and at least two signal members for communicating electrical signals, and at least one of the signal members defining a common member;

at least one bead that defines opposing slots whereby the bead is strung onto the thread bundle; and at least one light source adapted for attaching to the thread bundle at one end thereof by engaging a respective distal end of the tether and connecting the light source to the common member and to a selected one of the signal members, the remaining signal members and common member for being connected to mating signal members and common member in an adjacent thread bundle; and signal means for generating electrical signals for illuminating each of said light sources in a sequence, whereby the signal members connect to the signal means for communicating electrical signals to the light sources.

13. A method of assembling a light-emitting beaded necklace for ornamental decoration, comprising the steps of:

(a) electrically connecting together at least two threaded bead assemblies, each bead assembly comprising:

an elongate thread bundle having a tether and at least two signal members for communicating electrical signals, and at least one of the signal members defining a common member;

at least one bead that defines opposing slots whereby the bead is strung onto the thread bundle; and at least one light source adapted for attaching to the thread bundle at one end thereof by engaging a respective distal end of the tether and connecting the light source to the common member and to a selected one of the signal members, the remaining signal members and common member at the one end for being connected to mating signal members and common member in an adjacent thread bundle, the common member and signal members connected to a electrical signal source; and (b) generating electrical signals by the signal source for illuminating each of said light sources in a sequence, whereby the light sources, being caused to illuminate, provide a lighted ornamental effect for the beaded necklace.

14. The method as recited in claim 13, further comprising the step of enclosing the light source in a light-transmissive bead attached to one end of the threaded bead assembly, whereby the electrical connections arc enclosed within the light-transmissive bead.

15. The method as recited in claim 13, further comprising the step of forming a stop at respective distal ends of the tether by securing a distal end portion of the tether to a plate.

16. The method as recited in claim 15, further comprising the step of securing the tether to a light-transmissive bead that encloses the light source by engaging the stop to a slotted plate in the light-transmissive bead.

17. A light-emitting beaded necklace for ornamental decoration, comprising:

a plurality of ornamental beads adapted for being strung onto a thread, including ornamental beads having light sources therein and ornamental beads not having light sources therein, wherein there is at least one ornamental bead not having a light source therein between all adjacent ornamental beads having light sources therein;

an elongate thread which receives the beads in sequence and having distal ends connected together at distal ends to define a looped article of wearing apparel;

means for generating an electrical signal for illuminating the light sources in the beads, whereby the light sources, being caused to illuminate, provide a lighted ornamental effect for the beaded necklace, wherein the ornamental beads having light sources therein are larger than the ornamental beads not having light sources therein.

18. A light-emitting beaded necklace for ornamental decoration, comprising:

a plurality of ornamental beads adapted for being strung onto a thread, including ornamental beads having light sources therein and ornamental beads not having light sources therein;

an elongate thread which receives the beads in sequence and having distal ends connected together at distal ends to define a looped article of wearing apparel;

means for generating an electrical signal for illuminating the light sources in the beads, whereby the light sources, being caused to illuminate, provide a lighted ornamental effect for the beaded necklace; and a container attached to the thread in the sequence of beads, wherein the means for generating an electrical signal and a power supply arc disposed within the container.

19. The light-emitting necklace as recited in claim 18, wherein the ornamental beads having light sources therein are larger than the ornamental beads not having light sources therein.

20. The light-emitting necklace as recited in claim 18, wherein there are at least three ornamental beads not having light sources therein between all adjacent ornamental beads having light sources therein.

21. The light-emitting necklace as recited in claim 18, wherein the container comprises a pendent.

* * * * *